US007591059B2

(12) United States Patent
MacAulay et al.

(10) Patent No.: US 7,591,059 B2
(45) Date of Patent: Sep. 22, 2009

(54) EXPANSION ACTIVATED ANTI-ROTATION DEVICE

(75) Inventors: Iain C. MacAulay, Aberdeen (GB); Simon J. Harrall, Houston, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 420 days.

(21) Appl. No.: 11/224,832

(22) Filed: Sep. 13, 2005

(65) Prior Publication Data

US 2007/0057508 A1 Mar. 15, 2007

(51) Int. Cl.

| | |
|---|---|
| ***B21D 39/00*** | (2006.01) |
| ***B21D 53/84*** | (2006.01) |
| ***B23P 17/00*** | (2006.01) |
| ***E21B 23/00*** | (2006.01) |
| ***F16L 15/02*** | (2006.01) |
| ***F16L 25/00*** | (2006.01) |
| ***F16L 37/00*** | (2006.01) |
| ***F16L 41/00*** | (2006.01) |

(52) U.S. Cl. ..... 29/421.1; 29/522.1; 285/100; 285/222; 285/291.2; 285/330; 285/391; 166/207; 403/277

(58) Field of Classification Search ..... 29/421.1, 29/522.1; 285/391, 330, 291.2, 222, 100; 166/207; 403/277

See application file for complete search history.

(56) References Cited

U.S. PATENT DOCUMENTS

| | | | | |
|---|---|---|---|---|
| 2,051,525 A | | 8/1936 | Howard | |
| 2,673,751 A | * | 3/1954 | Finch | 285/84 |
| 3,717,368 A | | 2/1973 | Czarnecki et al. | |
| 3,895,829 A | * | 7/1975 | Manson, Jr. | 285/3 |
| 6,283,511 B1 | * | 9/2001 | Kamp | 285/391 |
| 6,457,532 B1 | * | 10/2002 | Simpson | 166/380 |
| 6,607,220 B2 | * | 8/2003 | Sivley, IV | 285/334 |
| 6,712,401 B2 | * | 3/2004 | Coulon et al. | 285/331 |
| 6,767,035 B2 | | 7/2004 | Hashem | |
| 6,789,822 B1 | | 9/2004 | Metcalfe | |
| 6,920,932 B2 | | 7/2005 | Zimmerman | |

(Continued)

FOREIGN PATENT DOCUMENTS

| | | |
|---|---|---|
| EP | 1 403 464 | 3/2004 |

(Continued)

OTHER PUBLICATIONS

EP Search Report, Application No. 06120496.2, Jan. 31, 2007.

*Primary Examiner*—David P Bryant
*Assistant Examiner*—Alexander P Taousakis
(74) *Attorney, Agent, or Firm*—Patterson & Sheridan, L.L.P.

(57) ABSTRACT

Methods and apparatus for making a connection that can be rotationally locked by expansion are disclosed. Threaded tubular ends include a slot cut across a thread at a location along the circumference of the thread. Threading two tubular members that have the slot disposed in either or both of a pin or box end of the tubular members establishes the connection. The slots represent no impediment to the make-up or break-out of a box by pin connection prior to expansion. During expansion of the connection, the threads of either the box or pin end are forced via plastic flow into the slot in the corresponding thread. This results in locking the connection and preventing relative rotation between the two tubular members, which could otherwise loosen the connection.

12 Claims, 4 Drawing Sheets

U.S. PATENT DOCUMENTS

| | | | | |
|---|---|---|---|---|
| 6,971,685 | B2 | 12/2005 | Hashem | |
| 7,077,197 | B2 | 7/2006 | Harrall | |
| 2003/0234538 | A1 | 12/2003 | Hashem | |
| 2004/0017081 | A1 | 1/2004 | Simpson et al. | |
| 2004/0104575 | A1 | 6/2004 | Ellington et al. | |
| 2004/0207202 | A1 * | 10/2004 | Parks | 285/391 |
| 2004/0231839 | A1 | 11/2004 | Ellington et al. | |
| 2005/0133223 | A1 | 6/2005 | Harrall | |
| 2005/0285399 | A1 * | 12/2005 | Mosing et al. | 285/391 |

FOREIGN PATENT DOCUMENTS

| | | |
|---|---|---|
| GB | 2 095 360 | 9/1982 |
| WO | WO 00/57020 | 9/2000 |

* cited by examiner

EXPANSION ACTIVATED ANTI-ROTATION DEVICE

BACKGROUND OF THE INVENTION

1. Field of the Invention

Embodiments of the invention generally relate to tubular connections.

2. Description of the Related Art

In order to access hydrocarbons in subsurface formations, it is typically necessary to drill a bore into the earth. The process of drilling a borehole and of subsequently completing the borehole in order to form a wellbore requires the use of various tubular strings. These tubular members are typically run downhole where the mechanical and seal integrity of the jointed connections are critically important in the original make-up of the tubular members, during expansion of the tubular members, and after expansion of the tubular members.

Typically, simple male to female threaded connections connect multiple tubular members end-to-end. The male end is generally referred to as a pin, and the female end as a box. The tubular members are connected, or "made-up," by transmitting torque against one of the tubular members while the other tubular member is typically held stationary. Transmitting torque in a single direction corresponding with connection make-up tightens the threaded joint in order to establish the seal integrity and lock in the applied torque.

When running tubular members, there is sometimes a requirement to run jointed tubular members that will later be expanded by various types of expansion mechanisms. The most basic type of expander tool employs a simple cone-shaped body, which is typically run into a wellbore to the tubular member that is to be expanded. The expander tool is then forced through the tubular members to be expanded by pushing or pulling on the working string from the surface and/or applying fluid pressure on one side of the cone. Alternatively, rotary expander tools can employ one or more rows of compliant rollers that are urged outwardly from a body of the expander tool in order to engage and to expand the surrounding tubular member. The rotary expander tool is rotated downhole so that the actuated rollers can act against the inner surface of the tubular member to be expanded in order to expand the tubular body circumferentially. Radial expander tools are described in U.S. Pat. No. 6,457,532, issued to Simpson et al., and that patent is incorporated herein by reference in its entirety.

Expanding tubular members that use the same threaded connections as employed with conventional oil-field tubular members proves to be problematic. First, changes in geometry of the connection once expanded can reduce the locked in torque and the tensile capacity of the connection due to loss of intimate contact between the threads when the locked in torque is reduced. Additionally, a threaded connection potentially turns and loosens during expansion due to rotation and frictional contact of a rotary expansion tool. For example, left hand threaded box by pin connections rotate in the clockwise direction when expanded with the rotary expansion tool in the clockwise direction. This transferred rotation potentially slackens off the threaded connections within a multiple joint tubular string being expanded that is differentially stuck at the bottom when expansion takes place top down. On the other hand, transferred clockwise rotation from the rotary expansion tool potentially loosens the threaded connection regardless of differential sticking when expansion occurs in a bottom to top direction. Addition of right hand threaded connections for use in the tubular string to help remedy these problems related to undoing of the connection during expansion only present further issues such as inventory concerns and specialized equipment requirements.

Therefore, a need exists for an improved tubular connection that is capable of being made-up and broken-out numerous times prior to expansion while torsionally locking itself upon being expanded.

SUMMARY OF THE INVENTION

Embodiments of the invention generally relate to threaded tubular ends having a slot cut across a thread at a location along the circumference of the thread. A connection according to embodiments of the invention includes those formed between two tubular members that have the slot disposed in either or both of a pin or box end of the tubular members. The slots represent no impediment to the make-up or break-out of a box by pin connection prior to expansion. During expansion of the connection, the threads of either the box or pin end are forced via plastic flow into the slot in the corresponding thread. This results in locking the connection and preventing relative rotation between the two tubular members, which could otherwise loosen the connection.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
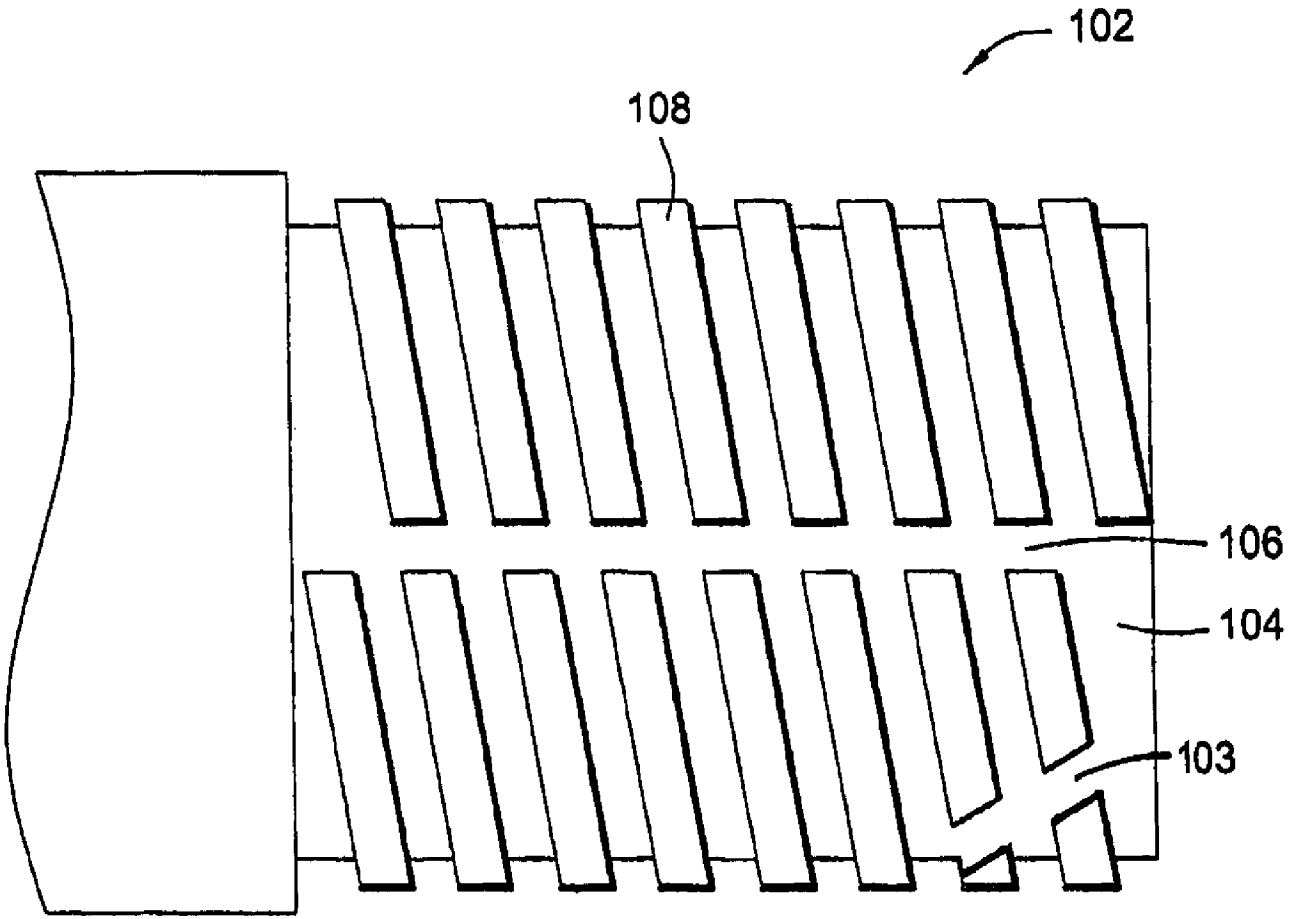
FIG. 1 is a side view of a portion of a tubular member having a pin end with an axial slot extending across threads formed on the pin end.

FIG. 1 shows a portion of a tubular member 102 having a pin end 104 with an axial slot 106 extending across a helical thread 108 formed on the pin end 104. The slot 106 interrupts the thread 108 at the same circumferential point along the entire axial length of the pin end 104. For some embodiments, the slot 106 extends across only a portion of the pin end 104 such that at least some individual turns of the thread 108 are continuous through the 360° of one turn. The slot 106 preferably extends from the crest of the thread 108 to a depth no greater than the root of the thread 108. In general, any standard pin end can be modified by cutting the slot 106 axially across the thread 108.

As with other embodiments described herein, multiple slots may be spaced around the circumference of the thread 108. For example, both the slot 106 and an additional slot 103 interrupt the thread 108 within a single 360° turn of the thread 108. The slots 103, 106 may be parallel or non-parallel to one another. The additional slot 103 can extend across only a portion of the pin end 104 as shown or can extend across the entire axial length of the pin end 104. Additionally, the size and shape of the slot(s) can vary. For example, the slot(s) can be at an angle or curved. Furthermore, the slots described herein represent no impediment to the make-up or break-out of a box by pin connection prior to expansion. Specifically, the thread continues as a normal thread on each side of the slot even though the thread is not continuous due to the slot.

Figure 2:
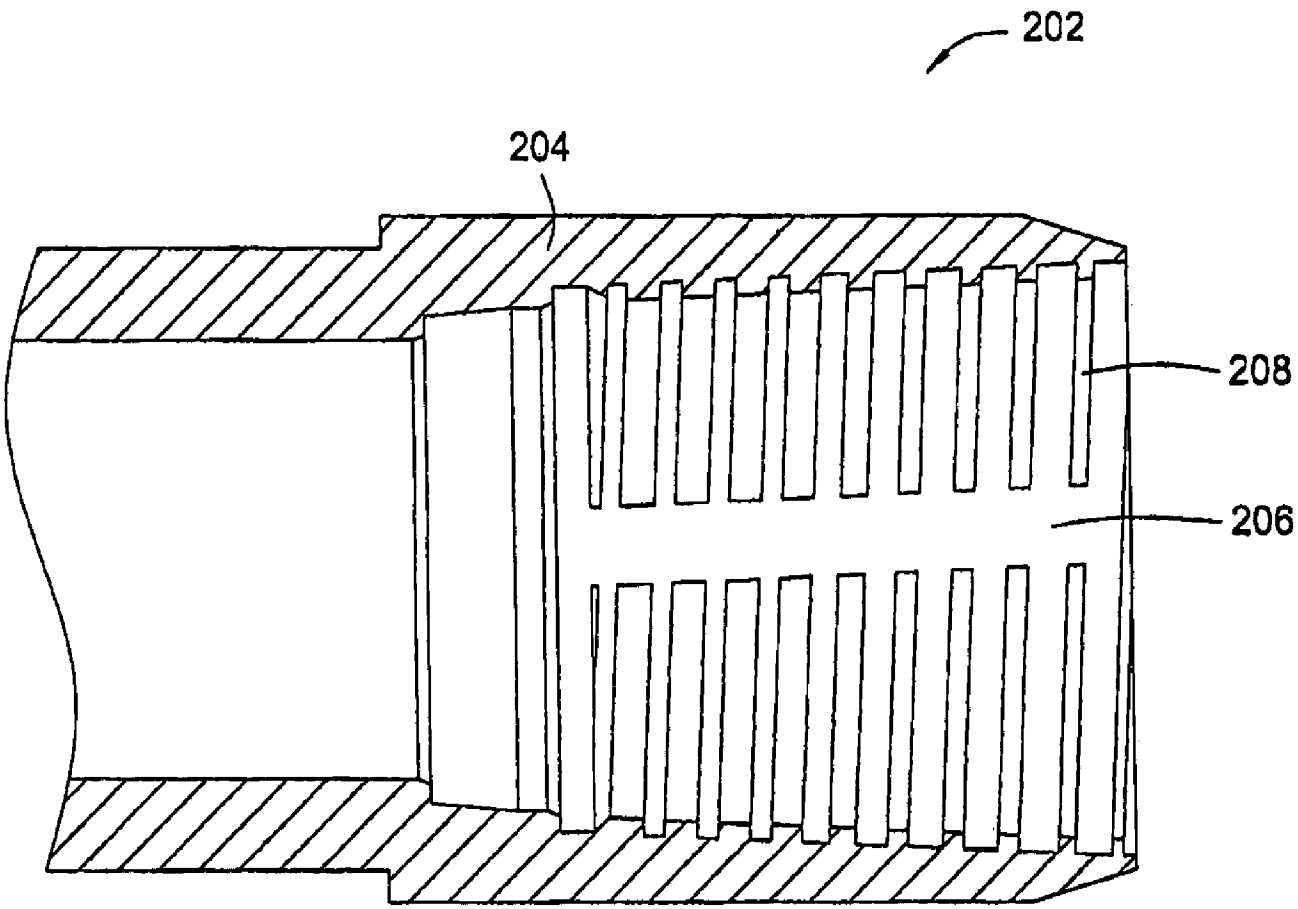
FIG. 2 is a cross sectional view of a portion of a tubular member having a box end with an axial slot extending across threads formed inside the box end.

FIG. 2 illustrates a portion of a tubular member 202 having a box end 204 with an axial slot 206 extending across threads 208 formed inside the box end 204. The slot 206 in the box end 204 serves a similar function and may be modified in a similar manner as the slot 106 in the pin end 104. Connections according to embodiments of the invention include those formed between tubular members that have the slot disposed in either or both of the pin or box ends.

Figure 3:
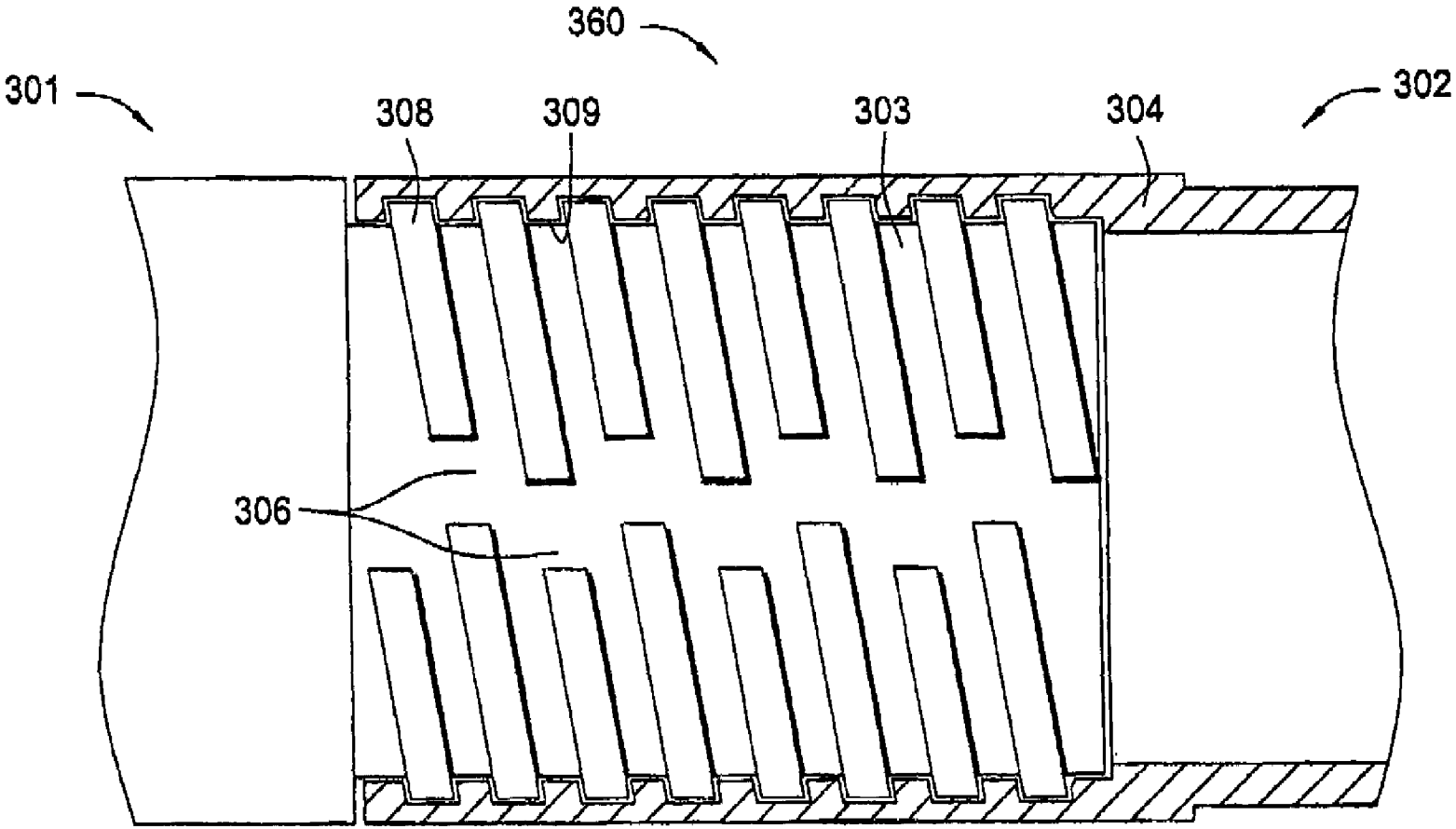
FIG. 3 is a partial cross sectional view of a connection between two tubular members with a box end cut away to illustrate a random pattern of slots in threads circumscribing a pin end.

FIG. 3 shows a connection 360 between a first tubular member 301 and a second tubular member 302 with a box end 304 of the second tubular member 302 cut away to illustrate a random pattern of a slot 306 disposed along a thread 308 circumscribing a pin end 303 of the first tubular member 301. The thread 308 of the pin end 303 mates with a corresponding thread 309 of the box end 304. The slot 306 cuts through individual turns of the thread 308 at various locations around the circumference of the pin end 303. In contrast to the embodiment shown in FIG. 1 where the slot 106 is straight, the slot 306 interrupts the thread 308 at different circumferential points along the axial length of the pin end 303. Again, the random pattern can be applied to a slot (not shown) in the corresponding thread 309 of the box end 304 as an alternative to or in combination with the slot 306 in the pin end 303 without departing from the scope of the invention.

Figure 4:
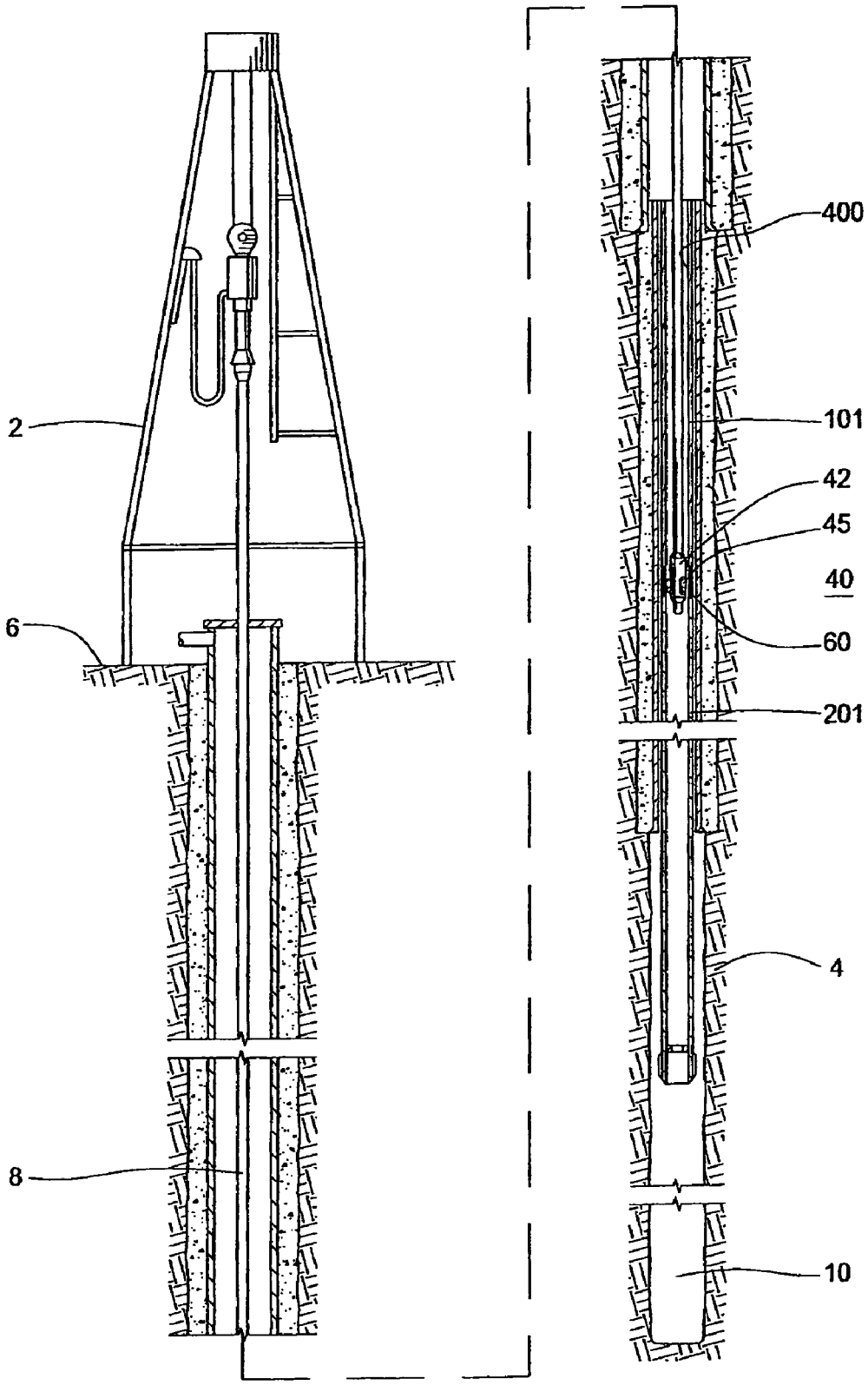
FIG. 4 is an elevation view schematically showing tubular members within a borehole and a representative expander tool at a connection according to aspects of the invention between two of the tubular members.

FIG. 4 illustrates embodiments of the invention in use within a wellbore 10. Accordingly, FIG. 4 shows a representative rig 2, a ground surface 6, a formation 4, a drill string or running string 8, a first tubular member 101, a second tubular member 201, a representative expander tool 40 comprising a body 42 and an extendable member 45 or roller, a bore 400 running through the tubular members, and a connection 60 or joint between the first tubular member 101 and the second tubular member 201. In operation, the first tubular member 101 and the second tubular member 201 are mated together at the surface 6 according to normal stab-in and threading procedures. The stab-in procedures can be preformed with tubular members arranged in a pin up and a box down configuration or a configuration with the pin down and the box up.

After run-in, the tubular members can be expanded from within by any method known to those skilled in the art. The expansion process can be run in any axial and/or rotational direction within the tubular members 101, 201 without risk of the connection rotating and loosening since the connection 60 becomes torsionally locked after being expanded as described below. The running string 8 with an expander tool 40 attached thereto runs through the bore 400 of the tubular members. At a desired location, an operator expands the tubular members using the expander tool 40.

When the expander tool 40 reaches the connection 60 between the first tubular member 101 and the second tubular member 201, an internal wall of a pin end expands into an internal wall of a box end. The connection 60 between the tubular members 101, 201 is capable of being expanded without losing its mechanical integrity. The threads of either the box or pin end are forced via plastic flow into a slot (e.g., the slots 106, 206 and/or 306 illustrated in FIGS. 1-3) on the corresponding thread of the other end. This results in locking the first and second tubular member 101, 201 together, thereby preventing rotation across the connection or relative rotation between the tubular members 101, 201. Thus, any rotation translated to the tubular members 101, 201 from rotation of the expander tool 40 cannot operate to break-out the connection 60 once the connection is expanded.

The plastic flow of material into the slots which are disclosed herein upon expansion of the connection can be caused to occur based at least on differential movement between the pin and box ends due to the expansion. For example, the pin end tends to elongate while the box end tends to contract when expanding the connection using rotary expansion methods. For some expansion methods such as those utilizing a cone or expansion mandrel, both the pin and box end can shrink with the relative amount of shrinkage of each end being sufficiently different to create the differential movement that at least enhances flow of material into the slots to lock the connection.

The expandable tubular members 101, 201 with the connection 60 according to aspects of the invention can be part of a liner, an open hole or cased hole patch that is run-in to a predetermined location or any other type of expandable tubular string for use in a well. A method in accordance with embodiments of the invention includes providing a first end of a first expandable tubular member and a second end of a second expandable tubular member, wherein a slot is disposed to intersect a circumference of a thread profile of the first end, the thread profile continuing on both sides of the slot, threading the first and second ends of the expandable tubular members to form a connection therebetween, and expanding the connection with a radial force. The method can further include running the expandable tubular members into a wellbore. The expanding of the connection can include extending extendable members of an expander tool and then rotating and axially translating the expander tool across the connection.

While the foregoing is directed to embodiments of the present invention, other and further embodiments of the invention may be devised without departing from the basic scope thereof, and the scope thereof is determined by the claims that follow.

The invention claimed is:

1. A method of expanding a connection between two expandable tubular members, comprising:

providing a first end of a first expandable tubular member and a second end of a second expandable tubular member, wherein the first expandable tubular member includes a slot that is cut into a thread profile of the first end substantially transverse to a circumference of the thread profile and the slot interrupts the thread profile at substantially the same circumferential point along a portion of the axial length of the first expandable tubular, the thread profile continuing on both sides of the slot threading the first and second ends of the expandable tubular members to form a connection therebetween; and expanding the connection with a radial force which causes a corresponding thread profile of the second end to plastically flow into the slot in the thread profile of the first end, thereby rotationally locking the connection.

2. The method of claim 1, further comprising running the expandable tubular members into a wellbore.

3. The method of claim 1, wherein expanding the connection includes rotating an expander tool.

4. The method of claim 1, wherein expanding the connection includes rotating and axially translating an expander tool.

5. The method of claim 1, wherein expanding the connection includes extending extendable members of an expander tool and then rotating and axially translating the expander tool across the connection.

6. A method for locking an expandable threaded connection, comprising:

providing a first tubular having a first threaded end;

providing a second tubular having a second threaded end, wherein of the first threaded end includes an interrupted thread form at points along an axial length of the first tubular and substantially transverse to a circumference of the first tubular;

engaging the first and second threaded ends; and expanding the first and second threaded ends which causes a thread profile of the second threaded end to plastically flow into the interrupted thread form of the first threaded end, thereby locating an abutment of the interrupted thread into locking engagement with the second threaded end.

7. The method of claim 6, wherein the interrupted thread form interrupts the respective threaded end at substantially the same circumferential point along a portion of the axial length of the respective tubular.

8. The method of claim 6, wherein the interrupted thread form interrupts the respective threaded end at different circumferential points along a portion of the axial length of the respective tubular.

9. The method of claim 6, wherein at least one of the first and second threaded ends includes a second interrupted thread form within a single 360 degree turn of the respective threaded end.

10. A method of expanding a connection between two expandable tubular members, comprising:

providing a first end of a first expandable tubular member and a second end of a second expandable tubular member, wherein the first expandable tubular member includes a slot that is cut into a thread profile of the first end substantially transverse to a circumference of the thread profile and the slot interrupts the thread profile at different circumferential points along a portion of the axial length of the first expandable tubular, the thread profile continuing on both sides of the slot;

threading the first and second ends of the expandable tubular members to form a connection therebetween; and expanding the connection with a radial force which causes a corresponding thread profile of the second end to plastically flow into the slot in the thread profile of the first end, thereby rotationally locking the connection.

11. A method of expanding a connection between two expandable tubular members, comprising:

providing a first end of a first expandable tubular member and a second end of a second expandable tubular member, wherein the first expandable tubular member includes a slot that is cut into a thread profile of the first end substantially transverse to a circumference of the thread profile, the thread profile continuing on both sides of the slot, wherein a second slot is cut into the first end which interrupts the thread profile within a single 360 degree turn of the thread profile;

threading the first and second ends of the expandable tubular members to form a connection therebetween; and expanding the connection with a radial force which causes a corresponding thread profile of the second end to plastically flow into the slot in the thread profile of the first end, thereby rotationally locking the connection.

12. A method of expanding a connection between two expandable tubular members, comprising:

providing a first end of a first expandable tubular member and a second end of a second expandable tubular member, wherein the first expandable tubular member includes a slot that is cut into a thread profile of the first end at points along an axial length of the first expandable tubular and substantially transverse to a circumference of the thread profile, the thread profile continuing on both sides of the slot;

threading the first and second ends of the expandable tubular members to form a connection therebetween; and expanding the connection with a radial force which causes a corresponding thread profile of the second end to plastically flow into the slot in the thread profile of the first end, thereby rotationally locking the connection.

* * * * *